US006027539A

United States Patent [19]

Toy

[11] Patent Number: 6,027,539

[45] Date of Patent: Feb. 22, 2000

[54] FIRE STARTER AND METHOD OF MAKING SAME

[75] Inventor: Daniel Toy, Brookfield, Wis.

[73] Assignee: Red-D-Lite, Inc., Brookfield, Wis.

[21] Appl. No.: 09/162,178

[22] Filed: Sep. 28, 1998

[51] Int. Cl.[7] ..... C10L 11/06

[52] U.S. Cl. ..... 44/532; 44/544; 44/576

[58] Field of Search ..... 44/532, 544, 576

[56] References Cited

U.S. PATENT DOCUMENTS

| | | | |
|---|---|---|---|
| 209,069 | 10/1878 | Norris | 44/576 |
| D. 223,722 | 5/1972 | Stehouwer | 48/27 |
| 725,993 | 4/1903 | Sachse | 44/544 |
| 2,933,378 | 4/1960 | Mustin et al. | 44/14 |
| 3,028,228 | 4/1962 | Chaplin | 44/14 |
| 3,116,704 | 1/1964 | Byars, Sr. et al. | 110/1 |
| 3,123,062 | 3/1964 | Psarris | 126/25 |
| 3,297,419 | 1/1967 | Eyre, Jr. | 44/6 |
| 3,367,758 | 2/1968 | Ambrose et al. | 44/40 |
| 3,377,147 | 4/1968 | Remines | 44/38 |
| 3,883,317 | 5/1975 | Neme | 44/14 |
| 3,988,121 | 10/1976 | Leveskis | 44/532 |
| 4,062,655 | 12/1977 | Brockbank | 44/6 |
| 4,189,305 | 2/1980 | Clayton | 44/41 |
| 4,243,393 | 1/1981 | Christian | 44/14 |
| 4,725,286 | 2/1988 | Brame | 44/38 |
| 4,781,128 | 11/1988 | Salner | 110/102 |
| 4,981,496 | 1/1991 | Hausslein | 44/531 |
| 4,984,384 | 1/1991 | Kaufmann | 47/9 |
| 5,711,766 | 1/1998 | Bain | 44/532 |

FOREIGN PATENT DOCUMENTS

| | | |
|---|---|---|
| 401357 | 8/1909 | France . |
| 216153 | 12/1924 | France . |
| 633932 | 2/1928 | France . |
| 351943 | 8/1961 | Switzerland . |
| 15072 | of 1884 | United Kingdom . |
| 10371 | of 1887 | United Kingdom . |
| 4777 | of 1909 | United Kingdom . |
| 402838 | 12/1933 | United Kingdom . |
| 609068 | 9/1948 | United Kingdom . |
| 839602 | 6/1960 | United Kingdom . |
| 2150594A | 7/1985 | United Kingdom . |

*Primary Examiner*—Ellen M. McAvoy
*Attorney, Agent, or Firm*—Jansson, Shupe, Bridge & Munger, Ltd.

[57] ABSTRACT

A firestarting device and a method of making the same is provided. The firestarting device includes an ignition ring formed from a mass of combustible material and having a predetermined thickness. The ignition ring defines an aperture therethrough having a width greater than the thickness of the ignition ring. A support structure formed from the mass of combustible material supports the ignition ring above a supporting surface. It is contemplated that the combustible material be formed from a combination of wax and combustible particles. The wax having a melting point in the range of 136° Fahrenheit to 166° Fahrenheit and the wood particles being finer than 55 mesh.

19 Claims, 3 Drawing Sheets

FIG. 1
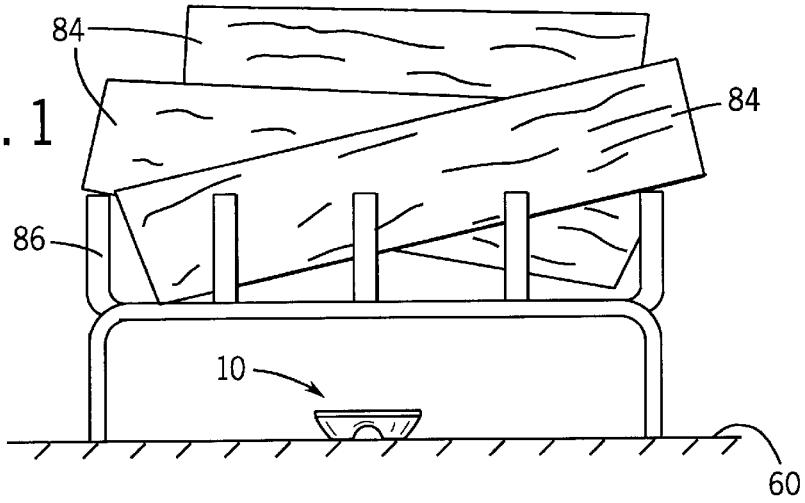
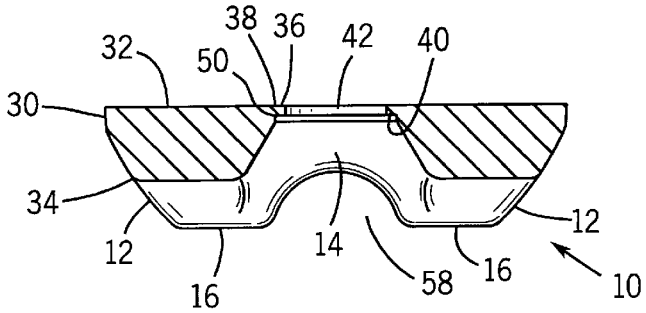
FIG. 2
FIG. 3
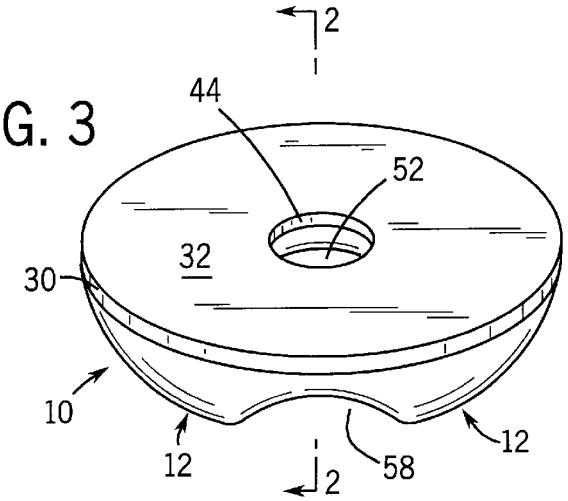

FIRE STARTER AND METHOD OF MAKING SAME

BACKGROUND AND SUMMARY OF THE INVENTION

This invention relates to a firestarter with improved burning properties and a method of making the same.

Firestarters formed from wax and wood particles are known. In one such type of firestarter, a generally rectangular block is placed below a quantity of material to be burned, such as charcoal or wood, and is ignited using a match or other flame source. The wax and wood particles burn to ignite the charcoal or wood. While this type of firestarter generally functions to ignite such material, a relatively large quantity of firestarter material must be used to generate a sufficiently intense flame for a long enough period of time to ignite the material to be burned.

Another type of firestarter consists of a ring-shaped mass of combustible material having integrally formed spacers for supporting the mass material above a supporting surface, such as the floor of a fireplace. The ring-shaped mass of material consists of a series of inverted frusto-conical sections interconnected by a series of inverted triangular connecting sections, all of which are formed of a solidified wax and wood mixture. The firestarter further includes a substantially central aperture partially defined by the intersection of the arcuate upper inner edges of the frusto-conical sections with the generally flat upper surface of the firestarter. Due to the thickness of the material adjacent the inner edges of the frusto-conical sections, it is difficult to S ignite in the firestarter along these inner edges of the frusto-conical sections.

It is also known in the prior art to provide a metal platform onto which wood chips are placed. The wood chips are coated with wax or are impregnated with a combustible fuel. The platform is provided with openings and is placed on the supporting surface, such as the floor of a fireplace. The chips are ignited by a user and generate flames which, in turn, ignite the fireplace logs. However, it has been found that the intensity of the flames generated by burning of the chips is often insufficient to ignite the fireplace logs. Further, since a separate metal platform is required to facilitate the burning of the chips, the platform must be recovered from the ashes before subsequent reuse to ignite a new fire.

Therefore, it is a primary object and feature of the present invention to provide a firestarter which is simple in its operation and yet provides satisfactory performance in igniting combustible materials such as charcoal and logs.

It is a further object and feature of the present invention to provide a method of making a firestarter which is relatively simple and inexpensive.

It is a still further object and feature of the present invention to provide a firestarter which ignites easily and generates a flame of sufficient intensity for a long enough period of time to ignite the material to be burned.

It is a still further object and feature of the present invention to provide a firestarter which overcomes some of the problems and shortcomings of the devices in the prior art.

In accordance with the present invention, a firestarting device is provided. The firestarting device includes an ignition ring formed from a mass of combustible material and having a predetermined thickness. The ignition ring defines an aperture therethrough having a width greater than the thickness of the ignition ring. A support structure formed from the mass of combustible material supports the ignition ring above a supporting surface.

The mass of combustible material is approximately 30% by weight of sawdust. In a preferred embodiment, the sawdust is finer than 60 mesh.

The support structure defines an airgap in communication with the aperture for providing the flow of air through the aperture during combustion of the mass of combustible material. The support structure includes first and second legs. The legs partially define a generally conical central chamber communicating with the aperture. The support structure is interconnected to the ignition ring by a body portion formed from the mass of combustible material.

The body portion includes a generally planar upper surface. The generally planer upper surface of the body portion is coplanar with an upper face of the ignition ring. The ignition ring also includes a generally lower face parallel to the upper surface of a body portion. The upper face and the lower face of an ignition ring define the thickness of the ignition ring.

The firestarting device may also include a connection structure formed from the mass of combustible material for interconnecting the first and second legs. The connection structure includes a generally arcuate edge which partially defines the air gap in the support structure. It is also contemplated that the body portion define a generally circular outer edge. An arcuate outer surface depends from the outer edge at an angle less than 180°.

In accordance with a still further aspects of the present invention, a method is provided for forming a firestarter. The method includes the steps of forming a plurality of pellets from a combustible material. Depositing the pellets in a mold and compressing the pellets in the mold to a predetermined shape.

The method may also include the step of mixing wax and wood particles to form the combustible material. It is contemplated that the combustible material includes approximately 30% by weight of wood particles. It is further contemplated that the wood particles be finer than 55 mesh, and preferably equal to 60 mesh.

In order to compress the pellets in the mold to form a predetermined shape, the pellets are subjected to pressure greater than 1000 psi.

In accordance with a still further aspect of the present invention, a device for starting fires is provided. The device includes a mass of combustible material formed partially from wood particles finer than 55 mesh, and preferably equal to 60 mesh. A support structure supports the mass on a supporting surface.

The combustible material may partially formed from wax. However, it is preferred that the combustible material be approximately 30% by weight of wood particles finer than 55 mesh.

The device may further include an ignition ring formed from the mass of combustible material. An ignition ring has a predetermined thickness and defines an aperture therethrough having a width greater than the thickness of the ignition ring.

A support structure defines an air gap in communication with the aperture for providing the flow of air to the aperture during combustion of the mass of combustible material.

It is further contemplated that the mass of combustible material include a generally flat upper surface and a generally circular outer edge depending from the upper surface at an acute angle thereto. An oblique outer surface extends from the outer edge at an angle less than 180°.

BRIEF DESCRIPTION OF THE DRAWINGS

The drawings furnished herewith illustrate a preferred construction of the present invention in which the above advantages and features are clearly understood as well as others which will be readily understood from the following description of the illustrated embodiment.

In the drawings:

FIG. 1 is a front elevational view showing a firestarter in accordance with the present invention in use for igniting logs supported on a fireplace grate.

FIG. 2 is a cross-sectional view of the firestarter of the present invention taken along line 2—2 of FIG. 3.

FIG. 3 is an isometric view of the firestarter of the present invention.

DETAILED DESCRIPTION OF THE PREFERRED EMBODIMENT

Referring to FIG. 3, a firestarter in accordance with the present invention is generally designated by the reference 10. Firestarter 10 includes a series of spaced inverted legs 12 interconnected by a series of inverted, generally arcuate connecting sections 14.

Figure 4:
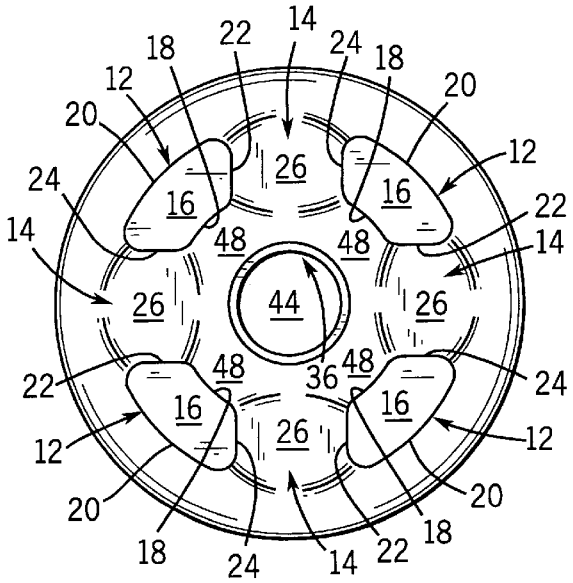
FIG. 4 is a bottom plan view of the firestarter of the present invention.

Each leg 12 includes a generally flat lower surface 16 having a generally trapezoidal shape, FIG. 4. Lower surface 16 of each leg 12 is defined by a radially inner edge 18 and a radially outer edge 20 spaced therefrom by first and second side edges 22 and 24, respectively. Side edge 22 is interconnected to side edge 24 of an adjacent leg 12 by inner arcuate surface 26 of a corresponding arcuate connection section 14.

Radially outer edges 20 of legs 16 are interconnected to a generally vertical surface 30 which extends about the outer periphery of firestarter 10 and which depends from generally planar upper surface 32 at an arcuate angle thereto by generally oblique, arcuate outer surfaces 34. Outer surfaces 34 of legs 16 extend between adjacent connecting sections 14 of firestarter 10.

As best seen in FIG. 2, a relatively thin ignition ring 36 projects radially inward from upper surface 32 of firestarter 10 and includes a generally planar upper ignition ring surface 38 which is generally coplanar with the upper surface 32 of firestarter 10. Ignition ring 36 further includes a lower ignition ring surface 40 which is generally planar and spaced from upper ignition ring surface 38 by a vertical, generally circular ignition ring wall 42. Ignition ring wall 42 defines the boundaries of an aperture 44 in firestarter 10. As best seen in FIG. 3, aperture 44 is centrally located through firestarter 10.

In the preferred embodiment, the height of ignition ring wall 42 is less than the width of aperture in firestarter 10, and preferably, the height of ignition ring wall 42 is less than one-half the width of aperture 44.

Firestarter 10 further includes a generally oblique, arcuate inner wall 48 which extends between corresponding connecting sections 14 of firestarter 10 and which interconnects the radially inner edges 18 of legs 12 with radially inner edge 50 of ignition ring 36. Inner walls 48 partially define a generally conical, central chamber 52 within firestarter 10. It is contemplated that inner walls 48 diverge from a vertical axis, perpendicular to the upper surface 32 of firestarter 10 and passing through the center of aperture 44, at an angle of approximately 30 degrees thereto to facilitate the venturi effect hereinafter described.

Central chamber 52 communicates with passages 58 which are bounded by arcuate surfaces 26 of connecting sections 14 and by side edges 22 and 24 of adjacent legs 12. When the lower surfaces 16 of legs 12 are engaged with a supporting surface 60 to support firestarter 10 thereon, passages 58 communicate with and provide the flow of air to central chamber 52 and to aperture 44.

Firestarter 10 is formed from a combination of wax and combustible particles, such as wood particles. Specifically, firestarter 10 is constructed from a premium wax base mixed with conventional fine sawdust. A premium wax is contemplated such that firestarter 10 burns cleaner with less black smoke.

In order to discourage the melting of firestarter 10 =during storage and transport and yet allow for the burning of the same, it is contemplated that the wax have a melting point in the range of 136° Fahrenheit to 166° Fahrenheit. Further, in order to facilitate the quick ignition of firestarter 10, it is contemplated that the sawdust be finer than 55 mesh and be formed from kiln-dried white pine with no foreign particles therein.

In a preferred embodiment, the wax and sawdust are provided in a ratio of approximately 7:3, i.e., seven parts by weight of wax to three parts by weight of sawdust. If a greater portion of wax, i.e. 80 to 90 percent by weight, is used to form firestarter 10, firestarter 10 would be susceptible to collapse and discourage proper burning.

Figure 5:
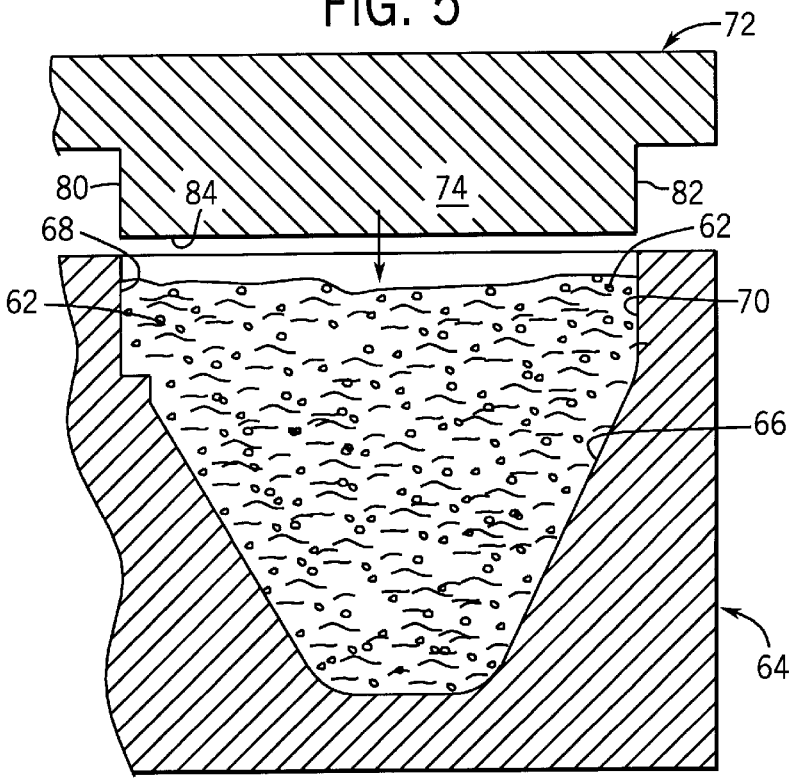
FIG. 5 is a cross-sectional view showing a mold Ifarrangement for forming the firestarter of FIGS. 1–4 in an open position.
Figure 6:
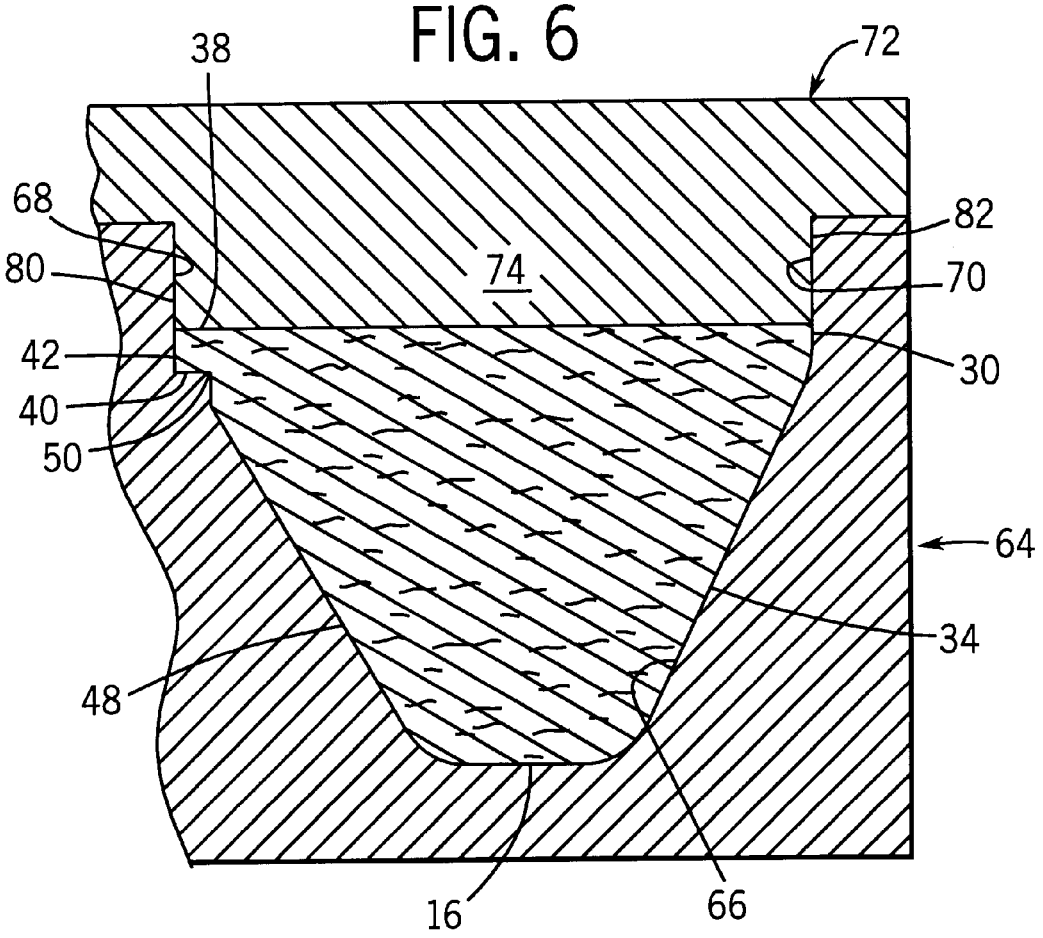
FIG. 6 is a cross-sectional view showing the mold arrangement of FIG. 5 in a closed position.

Referring to FIGS. 5 and 6, a method of manufacturing firestarter 10 is disclosed. As heretofore described, the basic ingredients deployed in the manufacture of firestarter are a quantity of wax and a quantity of sawdust. The wax is heated to a predetermined temperature in order to melt the wax such that the wax is in a liquid state. The wax is then placed into a mixer and sawdust is added. The liquid wax penetrates and impregnates the individual particles of sawdust during the mixing of the wax and sawdust within the mixer. Thereafter, a plurality of pellets 62 are formed from the mixture in a manner known in the art.

FIGS. 5 and 6 show cross-sections through molds 64 wherein molds 64 are in open and closed positions, respectively. Referring to FIG. 5, mold 64 includes a ring shaped mold cavity 66 having mold surfaces which correspond in shape to the shape of firestarter 10, as illustrated in FIGS. 1–4 and as described above. Mold 64 further includes a ring-shaped upwardly facing opening or entrance defined by inner and outer walls 68 and 70, respectively, leading into mold cavity 66. A ram 72 having a ring-shaped member 74 depending therefrom is employed in combination with mold 64.

A quantity of solidified pellets 62 is deposited into mold cavity 66 through the entrance thereto defined by walls 68 and 70. Thereafter, ram 72 is moved downwardly toward mold 64 such that the ring-shaped member 74 of ram 72 extends into the entrance of mold cavity 66 defined by walls 68 and 70. As best seen in FIG. 6, the inner and outer walls 80 and 82, respectively, of ring-shaped member 74 are in close proximity to corresponding walls 68 and 70 of mold 64. As ram 72 moves downwardly into mold cavity 66, the generally planar lower surface 84 of ring-shaped member 74 engages the pellets 62 in mold cavity 66 of mold 64. A downward force is exerted on ram 72 so as to apply pressure to the pellets 62 contained within mold cavity 66. In the preferred embodiment, ram 72 exerts pressure on pellets 62 greater than 1000 psi.

After the application of the pressure by ram 72 to pellets 62 within mold cavity 66 of mold 64 for a predetermined period of time, ram 72 is retracted vertically upward away from mold 64. The application of the pressure to pellets 62 by ram 72 results in pellets 62 being converted into a solid mass of material, i.e. firestarter 10, which is then removed from mold cavity 66 in a conventional manner. Mold 64 may include a plurality of mold cavities 66 for mass production of firestarter 10.

In operation, firestarter 10 is constructed in accordance with the method disclosed in FIGS. 5 and 6 and heretofore described. Referring to FIG. 1, a user places logs 84 into a fireplace grate 86, and then places firestarter 10 on supporting surface 60 such that the lower surfaces 16 of legs 12 rest on supporting surface 60. A user then lights a match and places the match through aperture 44. The lighted match easily ignites the ignition ring 36 at a location adjacent the flame thereby initially igniting firestarter 10. Due to the minimal thickness of ignition ring 36 and the composition -:of the material from which firestarter 10 is formed, the flame readily ignites ignition ring 36 and migrates outwardly to ignite the remaining portions of firestarter 10.

Since firestarter 10 is formed from material which is relatively dense to the high pressure exerted thereon during manufacture, firestarter 10 burns for a significant period of time. During combustion of firestarter 10, passages 58 between legs 12 function to supply air to aperture 44. Passages 58, central chamber 52 and aperture 44 in firestarter 10 are sized so as to facilitate a venturi effect through passages 58, control chamber 52 and upwardly through aperture 44 to accelerate the air during combustion of firestarter 10. The venturi effect results in a relativity high central flame emanating from aperture 44, i.e. a fifteen to seventeen inch flame. It is contemplated that the flame generated by firestarter 10 contacts the undersides of logs 84 so as to ignite the logs 84 without the use of kindling.

While firestarter 10 has been shown and described in connection with the lighting of logs in a fireplace, it is contemplated as being the scope of the present invention to utilize firestarter 10 in connection with other applications where it is desirable to ignite combustible materials, such as the ignition campfires, charcoal in a grill, or the like.

Various alternatives and embodiments are contemplated as being within the scope of the following claims, particularly pointing out and distinctly claiming subject matter as regarded as the invention.

I claim:

1. A fire starter, comprising:

an ignition ring formed from a mass of combustible material and having a predetermined thickness, the ignition ring defining an aperture therethrough having a diameter greater than the thickness of the ignition ring; and a support structure formed from the mass of combustible material and supporting the ignition ring above a supporting surface.

2. The fire starter of claim 1 wherein the mass of combustible material includes approximately 30% by weight of sawdust.

3. The fire starter of claim 2 wherein the sawdust is finer than 55 mesh and is formed from kiln-dried white pine.

4. The fire starter of claim 1 wherein the support structure defines an air gap in communication with the aperture for providing the flow of air to the aperture during combustion of the mass of combustible material.

5. The fire starter of claim 1 wherein the support structure includes first and second legs, the legs partially defining a generally conical chamber communicating with the aperture.

6. The fire starter of claim 1 wherein the support structure is interconnected to the ignition ring by a body portion formed from the mass of combustible material.

7. The fire starter of claim 6 wherein the body portion includes a generally planer upper surface.

8. The fire starter of claim 7 wherein the ignition ring includes a generally planer upper face co-planer with the upper surface of the body portion.

9. The fire starter of claim 8 wherein the ignition ring includes a generally planer lower face parallel to the upper surface of the body portion.

10. The fire starter of claim 9 wherein the upper face and the lower face of the ignition ring define the thickness of the ignition ring.

11. The fire starter of claim 5 further comprising a connection structure formed from the mass of combustible material for interconnecting the first and second legs.

12. The fire starter of claim 11 wherein the connection structure includes a generally arcuate edge, the arcuate edge partially defining the air gap in the support structure.

13. The fire starter of claim 7 wherein the body portion defines a generally circular, outer edge surface depending from the upper surface at an acute angle thereto.

14. The fire starter of claim 13 wherein the body portion defines an oblique, outer surface extending from the outer edge surface at an angle less than 180 degrees.

15. A method of forming a firestarter, comprising the steps of:

forming a plurality of pellets from a combustible material;

depositing the pellets in a mold; and compressing the pellets in the mold to form a predetermined shape.

16. The method of claim 15 further comprising the step of mixing wax and wood particles to form the combustible material.

17. The method of claim 16 wherein the combustible material comprises approximately 30% by weight of wood particles.

18. The method of claim 17 wherein the wood particles are kiln-dried white pine particles approximately equal to 60 mesh.

19. The method of claim 15 wherein the step of compressing the pellets includes the step of subjecting the pellets to pressure greater than 1000 psi.

* * * * *

UNITED STATES PATENT AND TRADEMARK OFFICE

CERTIFICATE OF CORRECTION

PATENT NO. : 6,027,539

DATED : February 22, 2000

INVENTOR(S) : Daniel Toy

It is certified that error appears in the above-identified patent and that said Letters Patent is hereby corrected as shown below:

On the title page item [54], delete, "FIRE STARTER" and insert – FIRESTARTER–.

In column 1, line 1, delete "FIRE STARTER" and insert –FIRESTARTER–.
In column 1, line 7, after "firestarter" and before "with", insert the following: –, and in particular, to a firestarter–;
In column 1, line 31, after "to", delete "S";
In column 3, lines 19-20, delete "Ifar-rangement" and insert –arrangement–;
In column 4, line 21, after "10" and before "during", delete "=";
In column 5, line 24, before "of", delete "-:".

Signed and Sealed this

Thirtieth Day of January, 2001

*Attest:*

Q. TODD DICKINSON

*Attesting Officer*

*Director of Patents and Trademarks*